US008264348B2

(12) United States Patent
Dinh

(10) Patent No.: US 8,264,348 B2
(45) Date of Patent: Sep. 11, 2012

(54) INTERFERENCE DETECTOR RESULTING IN THRESHOLD ADJUSTMENT

(75) Inventor: Erik Lee Dinh, Boca Raton, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 533 days.

(21) Appl. No.: 12/534,438

(22) Filed: Aug. 3, 2009

(65) Prior Publication Data

US 2011/0025498 A1 Feb. 3, 2011

(51) Int. Cl.
*G08B 21/00* (2006.01)

(52) U.S. Cl. ..... 340/540; 340/572.4

(58) Field of Classification Search ..... 340/540, 340/10.1, 10.2, 572.1, 572.4; 370/230
See application file for complete search history.

(56) References Cited

U.S. PATENT DOCUMENTS

| | | | | |
|---|---|---|---|---|
| 4,667,185 | A * | 5/1987 | Nourse et al. | 340/572.4 |
| 5,414,411 | A | 5/1995 | Lahr | |
| 2006/0244598 | A1 * | 11/2006 | Hyde et al. | 340/572.1 |
| 2007/0046288 | A1 | 3/2007 | Westersten | |
| 2008/0144493 | A1 * | 6/2008 | Yeh | 370/230 |
| 2010/0176947 | A1 | 7/2010 | Hall | |
| 2010/0182129 | A1 * | 7/2010 | Hyde et al. | 340/10.2 |

FOREIGN PATENT DOCUMENTS

WO 2008028487 A1 3/2008

OTHER PUBLICATIONS

International Search Report and Written Opinion dated Sep. 30, 2010 for International Application No. PCT/CA2010/001970, International Filing Date Jul. 14, 2010 (9-pages).

* cited by examiner

*Primary Examiner* — John A Tweel, Jr.
(74) *Attorney, Agent, or Firm* — Alan M. Weisberg; Christopher & Weisberg, P.A.

(57) ABSTRACT

A method and system are provided for adjusting a threshold value of an alarm for a metal detecting system, based on a detected interference with other systems that operate at adjacent frequencies. The method and system include receiving a plurality of sample values and calculating a discrepancy value based on a difference between a maximum value and a minimum value of the plurality of sample values, wherein the discrepancy value corresponds to detected interference. The discrepancy value is compared to a predefined interference threshold value and an activation signal is generated. A fast threshold adjustor receives the activation signal when the discrepancy value is greater than or equal to the predefined interference threshold value and a slow threshold adjustor receives the activation signal when the discrepancy value is less than the predefined interference threshold value. The activation signal triggers an output from the fast threshold adjustor or the slow threshold adjustor that is applied to adjust the threshold value.

20 Claims, 6 Drawing Sheets

INTERFERENCE DETECTOR RESULTING IN THRESHOLD ADJUSTMENT

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates generally to a method and system for reducing false alarm signals in electronic theft detection systems and more specifically to a method and system for detecting interference levels between electronic article surveillance ("EAS") systems and metal detection systems and adjusting a sensitivity level to minimize false alarm trigger signals.

BACKGROUND OF THE INVENTION

Electronic Article Surveillance ("EAS") systems are detection systems that allow the detection of markers or tags within a given detection region. EAS systems have many uses. Most often EAS systems are used as security systems to prevent shoplifting from stores or removal of property from office buildings. EAS systems come in many different forms and make use of a number of different technologies.

Typical EAS systems include an electronic detection EAS unit, markers and/or tags, and a detacher or deactivator. The detection unit includes transmitter and receiver antennas and is used to detect any active markers or tags brought within the range of the detection unit. The antenna portions of the detection units can, for example, be bolted to floors as pedestals, buried under floors, mounted on walls, or hung from ceilings. The detection units are usually placed in high traffic areas, such as entrances and exits of stores or office buildings. The deactivators transmit signals used to detect and/or deactivate the tags.

The markers and/or tags have special characteristics and are specifically designed to be affixed to or embedded in merchandise or other objects sought to be protected. When an active marker passes through the detection unit, the alarm is sounded, a light is activated, and/or some other suitable control devices are set into operation indicating the removal of the marker from the proscribed detection region covered by the detection unit.

Most EAS systems operate using the same general principles. The detection unit includes one or more transmitters and receivers. The transmitter sends a signal at defined frequencies across the detection region. For example, in a retail store, placing the transmitter and receiver on opposite sides of a checkout aisle or an exit usually forms the detection region. When a marker enters the region, it creates a disturbance to the signal being sent by the transmitter. For example, the marker may alter the signal sent by the transmitter by using a simple semiconductor junction, a tuned circuit composed of an inductor and capacitor, soft magnetic strips or wires, or vibrating resonators. The marker may also alter the signal by repeating the signal for a period of time after the transmitter terminates the signal transmission. This disturbance caused by the marker is subsequently detected by the receiver through the receipt of a signal having an expected frequency, the receipt of a signal at an expected time, or both. As an alternative to the basic design described above, the receiver and transmitter units, including their respective antennas, can be mounted in a single housing.

Magnetic materials or metal, such as metal shopping carts, placed in proximity to the EAS marker or the transmitter may interfere with the optimal performance of the EAS system. Further, some unscrupulous individuals utilize EAS marker shielding, such as bags lined with metal foil, with the intention to shoplift merchandise without detection from any EAS system. The metal lining of these bags can shield tagged merchandise from the EAS detection system by preventing an interrogation signal from reaching the tags or preventing a reply signal from reaching the EAS system. When a shielded marker passes through the detection unit, the EAS system is not able to detect the marker. As a result, shoplifters are able to remove articles from stores without activating an alarm.

Metal detection systems are used in conjunction with EAS systems to detect the presence of metal objects such as foil lined bags. The metal detection system may use common transmitters and receivers with the EAS system. For metal detection, the transmitter sends a signal across the detection region at a predefined metal detection frequency. When a metal object enters the detection region, it creates a disturbance to the signal being sent by the transmitter. This disturbance caused by the metal object is subsequently detected by the receiver through the receipt of a modified signal. Upon detection of the modified signal, an alarm is sounded, a light is activated, and/or some other suitable control devices are set into operation indicating the presence of metal in a detection region.

The EAS systems and the metal detection systems operate at different energizing frequencies to prevent interference between the systems. For example, the EAS systems and the metal detection systems may use operating frequencies that are separated by 5 kHz. For various reasons, the operating frequencies of these systems may shift, causing signal interference. Conventional metal detection systems are not able to effectively solve interference problems. As a result, conventional metal detection systems are prone to producing false alarm signals. What is needed is a system and method of detecting interference levels between electronic article surveillance ("EAS") systems and metal detection systems and adjusting a sensitivity level for false alarm trigger signals.

SUMMARY OF THE INVENTION

The invention advantageously provides a method and system for adjusting a threshold value of an alarm event based on a detected interference level. The system includes a discrepancy calculating module that receives a plurality of sample values and calculates a discrepancy value based on a difference between a maximum value and a minimum value of the plurality of sample values. A comparing module is provided to compare the discrepancy value to a predefined interference threshold value and generate an activation signal. A fast threshold adjustment module receives the activation signal when the discrepancy value is greater than or equal to the predefined interference threshold value and a slow threshold adjustment module receives the activation signal when the discrepancy value is less than the predefined interference threshold value. The activation signal triggers an output from the fast threshold adjustment module or the slow threshold adjustment module that is applied to adjust the threshold value.

According to one embodiment, a method for adjusting a threshold value of an alarm event based on a detected interference level can include receiving a plurality of sample values and calculating a discrepancy value based on a difference between a maximum value and a minimum value of the plurality of sample values. The discrepancy value is compared to a predefined interference threshold value and an activation signal is generated. The activation signal is provided to a fast threshold adjustor when the discrepancy value is greater than the predefined interference threshold value and to a slow threshold adjustor when the discrepancy value is less than the predefined interference threshold value. The activation signal triggers an output from one of the fast threshold adjustor and the slow threshold adjustor and the threshold value is adjusted based on the output from the fast threshold adjustor or the slow threshold adjustor.

According to another embodiment, the invention provides a security system for adjusting a threshold value of an alarm event trigger based on a detected interference level. The security system includes an antenna, an electronic surveillance system that uses the antenna to detect the presence of active markers and a metal detection system that uses the antenna to detect metal objects. The metal detection system includes a discrepancy calculating module that uses a plurality of sample values to calculate a discrepancy value based on a difference between a maximum value and a minimum value of the plurality of sample values. A comparing module compares the discrepancy value to a predefined interference threshold value and generates an activation signal. The metal detection system includes a fast threshold adjustment module that receives the activation signal when the discrepancy value is greater than or equal to the predefined interference threshold value and a slow threshold adjustment module that receives the activation signal when the discrepancy value is less than the predefined interference threshold value, the activation signal triggering an output from one of the fast threshold adjustment module and the slow threshold adjustment module, the output being used to adjust the threshold value.

Additional aspects of the invention will be set forth in part in the description which follows, and in part will be obvious from the description, or may be learned by practice of the invention. The aspects of the invention will be realized and attained using the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
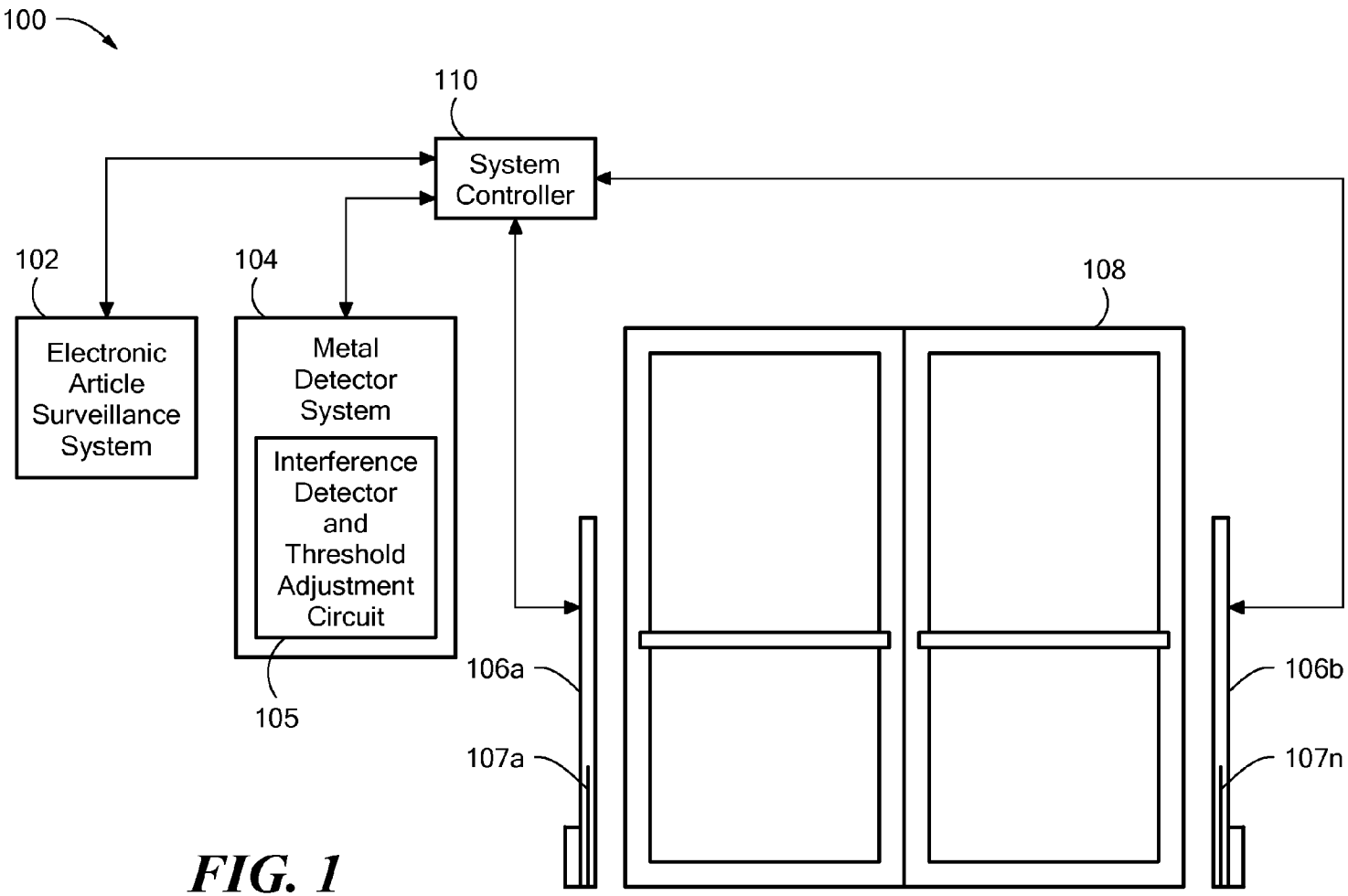
FIG. 1 is a block diagram of an exemplary security system having an EAS detection and metal detection capabilities constructed in accordance with the principles of the invention.

Before describing in detail exemplary embodiments that are in accordance with the invention, it is noted that the embodiments reside primarily in combinations of apparatus components and processing steps related to implementing a system and method of detecting interference levels between electronic article surveillance ("EAS") systems and metal detection systems and adjusting threshold values to reduce false alarm signals.

The system and method components are represented by conventional symbols in the drawings, where appropriate. The drawings show only those specific details that are pertinent to understanding the embodiments of the invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

One embodiment of the present invention advantageously provides a method and system for detecting interference levels between electronic article surveillance ("EAS") systems and metal detection systems and adjusting threshold values to minimize triggering false alarm signals.

The EAS systems detect markers that pass through a predefined detection area (also referred to as an interrogation zone). The markers may include strips of melt-cast amorphous magnetic ribbon, among other marker types. Under specific magnetic bias conditions, the markers receive and store energy, such as acousto-magnetic field energy, at their natural resonance frequency. When a transmitted energy source is turned off, the markers become signal sources and radiate the energy, such as acousto-magnetic ("AM") energy, at their resonant frequency. The EAS system is configured to detect the AM energy transmitted by the markers, among other energy.

One embodiment of the present invention advantageously provides a method and system for detecting the presence of metal in an interrogation zone of a security system and determining whether the detected metal is an EAS marker shield, such as a foil-lined bag. The security system combines traditional EAS detection capabilities with metal detection to improve the accuracy of the system, thereby reducing the likelihood of false alarms.

Referring now to the drawing figures where like reference designators refer to like elements, there is shown in FIG. 1 a security system constructed in accordance with the principles of the invention and designated generally "100." The security system 100 may be located at a facility entrance, among other locations. The security system 100 may include an EAS system 102, a metal detection system 104, and a pair of pedestals 106*a*, 106*b* (collectively referenced as pedestals 106) on opposing sides of an entrance 108, for example. The metal detection system may include an interference detector and threshold adjustment circuit 105. One or more antennas 107*a*, 107*n* (collectively referenced as antennas 107) may be included in pedestals 106 that are positioned a known distance apart for use by the EAS system 102 and the metal detection system 104. A system controller 110 is provided to control the operation of the security system 100 and is electrically coupled to the EAS system 102, the metal detection system 104, and the antennas 107, among other components. Of note, although the interference detector and threshold adjustment circuit 105 is shown in FIG. 1 as being a part of the metal detection system 104, it is contemplated that the interference detector and threshold adjustment circuit 105 can be separate or included in other elements of the system 100, e.g., as part of the system controller 110. Also, although the EAS system 102, the metal detection system 104 and the system controller 110 are shown as separate elements, such presentation is for ease of understanding and is not intended to limit the scope of the invention. It is contemplated that the EAS system 102, the metal detection system 104 and the system controller 110 can be incorporated in fewer than three physical housings.

According to one embodiment, the EAS system 102 applies a transmission burst and listening arrangement to detect objects, such as markers. The detection cycle may be 90 Hz (11.1 msec), among other detection cycles. The detection cycle may include four time periods that include a transmission window, a tag detection window, a synchronization window and a noise window. The transmission window may be defined as time period "A." During time period A, the EAS system 102 may transmit a 1.6-millisecond burst of the AM field at 58 kHz, to energize and interrogate markers that are within range of the transmitter and resonate at the same frequency. The markers may receive and store a sufficient amount of energy to become energy/signal sources. Once charged, the markers may produce an AM field at the 58 kHz until the energy store gradually dissipates in a process known as ring down.

The tag detection window may be defined as time period "B." The tag detection window may follow in time directly after the transmission window and may continue for 3.9 milliseconds (to 5.5 milliseconds). During time period B, the markers transmit signals while the system is idle (e.g., while the system is not transmitting signals). Time period B is defined by a quiet background level since the EAS system 102 is not transmitting signals. Typically, the AM field signal level for the EAS system 102 is several orders of magnitude larger that the AM field signal level for the marker. Without the EAS system 102 transmitting the AM field signal, the receiver is more easily able to detect the signal emanating from the markers.

The synchronization window may be defined as time period "C." The synchronization window may follow in time directly after the tag detection window and may continue for 1.6 milliseconds (to 7.1 milliseconds). The synchronization window allows the signal environment to stabilize after the tag detection window. Additionally, the noise window may be defined as time period "D." The noise window may follow in time directly after the synchronization window and may continue for 4.0 milliseconds (to 11.1 milliseconds). During the noise window, the communication environment is expected to be devoid of interrogation and response signals so that the noise component of the communication environment may be measured. The noise window allows the receiver additional time to listen for the tag signals. The energy in the marker may be fully dissipated during time period D, so the receiver may not detect AM signals emanating from the markers. Any AM signals detected during this time period may be attributed to unknown interference sources. For this reason, the alarm trigger signal may be disabled during time period D.

According to one embodiment, a metal detection system 104 is provided and may share hardware components with the EAS system 102. Accordingly, the metal detection system 104 may share antennas 107 with the EAS system 102. For example, the antennas 107 may be employed as transmitting antennas for the EAS system 102 and the metal detection system 104. The metal detection system 104 may monitor the signal for induced eddy currents that indicate the presence of metal objects located proximate to the antennas 107. Typically, for good conductors, the induced eddy currents dissipate in approximately tens of microseconds. By comparison, eddy currents dissipate approximately two orders of magnitude faster than the AM energy for acoustic markers.

The EAS system 102 and the metal detection system 104 may be designed to operate at different frequencies. For example, the EAS system 102 may operate at 58 kHz, while the metal detection system 104 may operate at 56 kHz. One of ordinary skill in the art will readily appreciate that these systems may operate at other frequencies. In order to avoid mutual interference during operation, the signals generated by the EAS system 102 and the metal detection system 104 are separated by at least the detection period, such as ⅙Hz or more.

However, if one or both of the EAS system 102 and the metal detection system 104 is subjected to a phase shift during operation that reduces their signal separation below the detection period, then the systems will experience mutual interference. For example, the EAS system 102 or the metal detection system 104 may undergo a phase shift to operate at lower noise periods, among other reasons.

Figure 2:
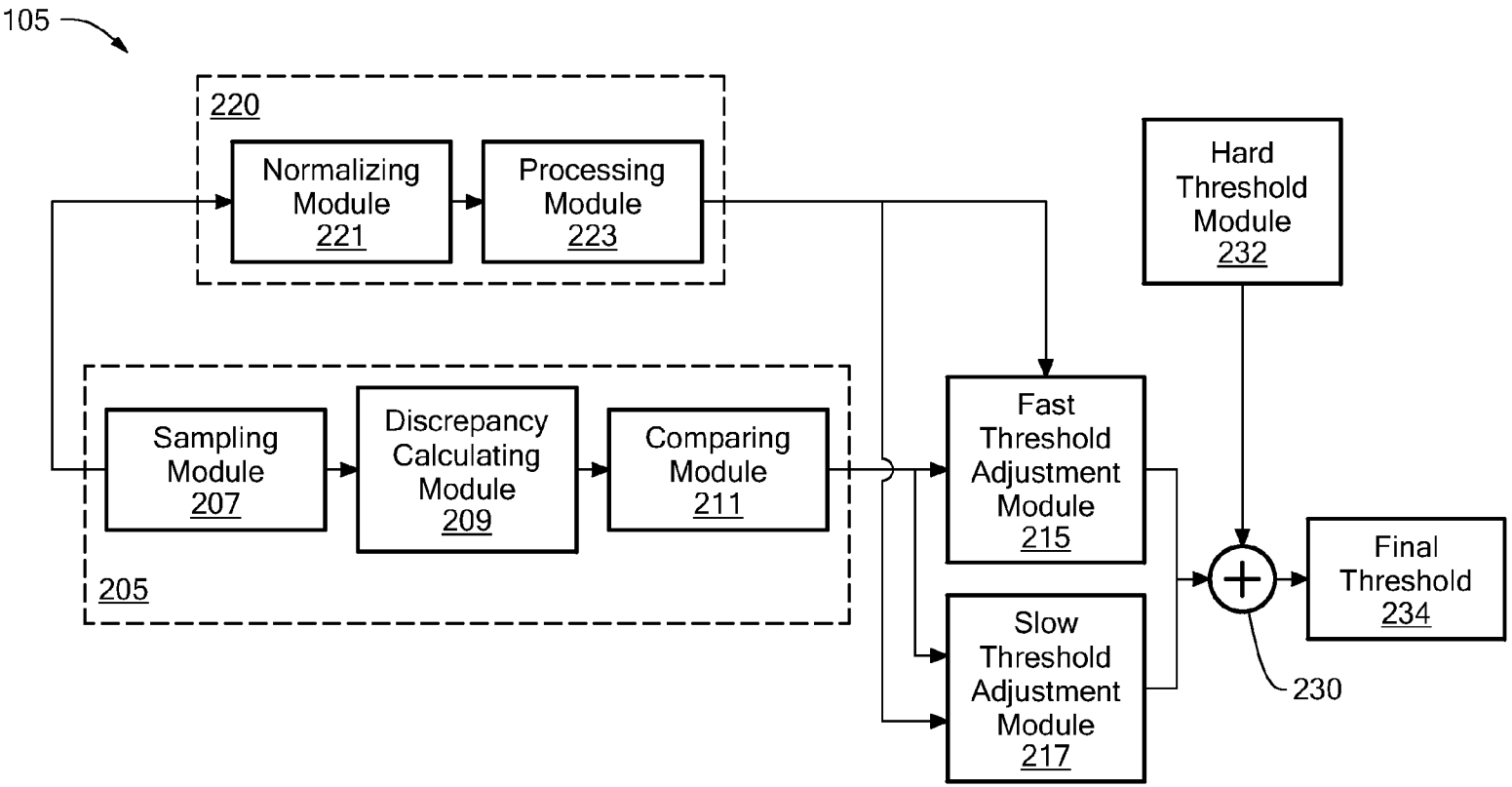
FIG. 2 is an exemplary schematic diagram of an interference detector and threshold adjustment circuit according to the principles of the present invention.

FIG. 2 is a schematic diagram of a first exemplary interference detector and threshold adjustment circuit 105. A threshold module 205 communicates with antennas 107 to receive and process signals emanating from nearby objects. The threshold module 205 selects a threshold adjustment speed based on a comparison between a calculated discrepancy value and a predefined interference threshold value. The threshold module 205 may include a sampling module 207, a discrepancy calculating module 209 and a comparing module 211.

The sampling module 207 extracts a predetermined number of sample values that are transmitted from the antenna 107. The sample values may represent signal strength or some other measureable feature of the received signal. For example, the sampling module 207 may operate at a frequency of 46.296 kHz and may extract sixteen (16) sample values representing signal strength. One of ordinary skill in the art will readily appreciate that the sampling module 207 may operate at other frequencies and may extract a different number of sample values. The discrepancy calculating module 209 receives the predetermined number of sample values from the sampling module 207 and determines a value for each sample, including a maximum value and a minimum value from the received sample values. The discrepancy calculating module 209 calculates a discrepancy value or a difference between the maximum value and the minimum value. According to one embodiment, the discrepancy calculating module 209 may calculate the discrepancy value continuously in real-time. The comparing module 211 receives the calculated discrepancy value from the discrepancy calculating module 209 and compares the discrepancy value with a pre-established interference threshold value.

If the comparing module 211 determines that the discrepancy value is greater than or equal to the pre-established interference threshold value, then the comparing module 211 selects a fast threshold adjustment module 215. For example, the fast threshold adjustment module 215 may be a 200 tap low pass filter (LPF) or other fast tap LPF. Alternatively, if the comparing module 211 determines that the discrepancy value is less than the pre-established interference threshold value, then the comparing module 211 selects a slow threshold adjustment module 217. For example, the slow threshold adjustment module 217 may be an 800 tap LPF or other slow tap LPF. One of ordinary skill in the art will readily appreciate that a greater number of threshold adjustment modules may be provided to enhance speed control granularity.

The interference detector and threshold adjustment circuit 105 may include a reduction module 220 that receives the plurality of sample values from the sampling module 207 and provides a single value to the fast threshold adjustment module 215 and the slow threshold adjustment module 217. The reduction module 220 may include a normalizing module 221 and a processing module 223. The normalizing module 221 receives and normalizes the plurality of sample values from the sampling module 207. For example, the normalizing module 221 may calculate an average value based on the plurality of sample values received from the sampling module 207. The processing module 223 receives the calculated average value from the normalizing module 221 and performs data reduction to transform the plurality of sample values to a single sample value. The processing module 223 provides the single sample value to the fast threshold adjustment module 215 and the slow threshold adjustment module 217.

As discussed above, the comparing module 211 selects one of the fast threshold adjustment module 215 or the slow threshold adjustment module 217 to process the single sample value provided by the processing module 223. If the fast threshold adjustment module 215 is selected, then the 200 tap LPF performs an average of the single sample value with 199 previously stored single sample values. Alternatively, if the slow fast threshold adjustment module 215 is selected, then the 800 tap LPF performs an average of the single sample value with 799 previously stored single sample values. According to one embodiment, both the 200 tap LPF and the 800 tap LPF store each single sample value, even if that LPF is not selected to process the single sample value.

The results from the corresponding n-tap LPF are provided to a summing module 230. According to one embodiment, the summing module 230 also receives a hard threshold value provided by a hard threshold module 232, such as a non-volatile memory. The hard threshold module 232 may include a table of values to adjust the sensitivity of the interference detector and threshold adjustment circuit 105. According to one embodiment, the summing module 230 calculates a final threshold value that is stored in the final threshold module 234.

Figure 3:
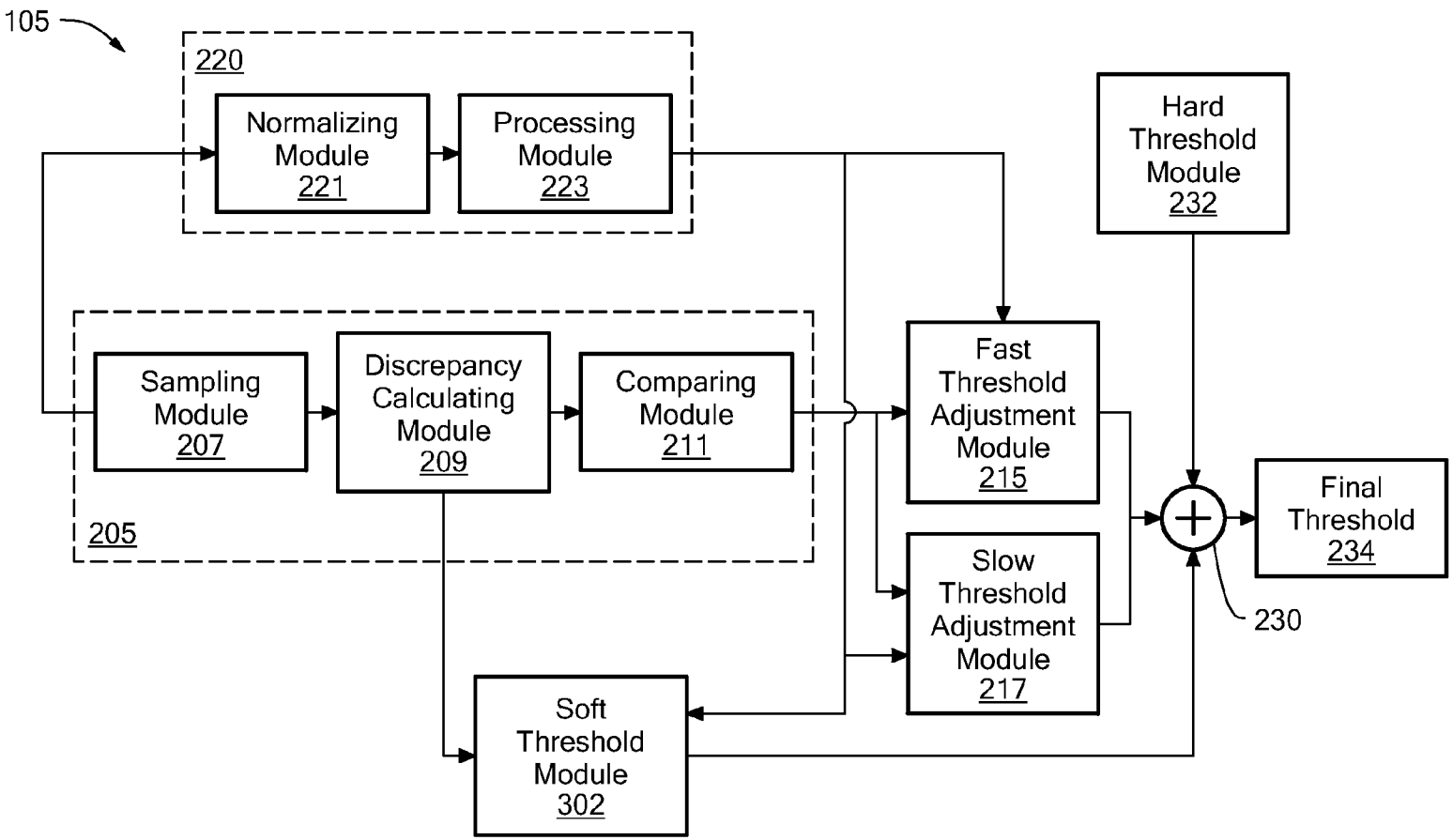
FIG. 3 is another exemplary schematic diagram of an interference detector and threshold adjustment circuit according to the principles of the present invention.

According to another embodiment of the invention, FIG. 3 is a block diagram of an second exemplary interference detector and threshold adjustment circuit 105 having components that provide a percentage of the calculated discrepancy value to calculate the final threshold value that is stored in the final threshold module 234. The interference detector and threshold adjustment circuit 105 adjusts the final threshold value based on real-time interference data.

The threshold adjustment circuit 105 in FIG. 3 includes a soft threshold module 302 that receives the discrepancy value from the discrepancy calculating module 209 and calculates a percentage of the discrepancy value or a soft threshold value. For example, the soft threshold module 302 may calculate the soft threshold value to be 10% of the discrepancy value obtained from the discrepancy calculating module 209. One of ordinary skill in the art will readily appreciate that other percentages may be selected for the soft threshold value.

The soft threshold module 302 is configured to receive a signal from the comparing module 211 when the calculated discrepancy is greater than or equal to the predefined interference threshold. If the comparing module 211 determines that the calculated discrepancy is less than the predefined interference threshold, then the signal is not provided to the soft threshold module 302. Upon receiving the signal from the comparing module 211, the soft threshold module 302 releases the soft threshold value to the summing module 230. According to one embodiment, the summing module 230 sums the soft threshold value, a hard threshold value provided by a hard threshold module 232, such as a non-volatile memory, and the results from the corresponding n-tap LPF. The summing module 230 calculates a final threshold value that is stored in the final threshold module 234. The final threshold module 234 may be coupled to an alarm decision module (not shown) that receives the threshold information to determine whether to generate or inhibit an alarm event.

Figure 4:
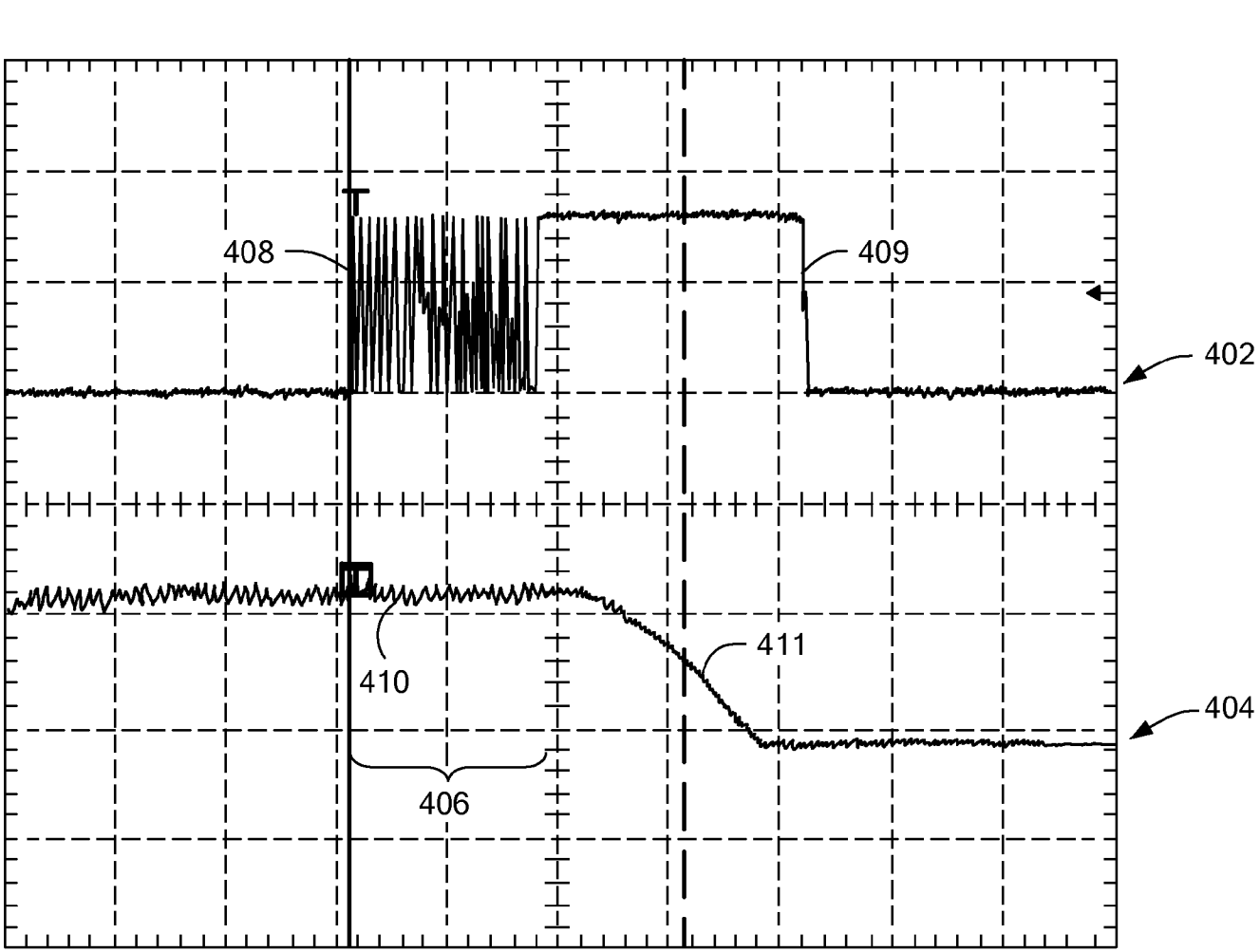
FIG. 4 is a waveform schematic diagram during a timeslot when no interference is detected between the EAS system and the metal detection system.

FIG. 4 is a waveform schematic diagram 400 showing two exemplary traces of signals that are generated by the metal detection system 104 during a timeslot or period when no interference is detected between the EAS system 102 and the metal detection system 104. An upper waveform 402 illustrates a digital signal generated by a microprocessor within the metal detection system 104. A lower waveform 404 illustrates a signal received at a front-end of the metal detection system 104. A window 406 defines a time frame or region of interest that is used to analyze waveforms 402, 404.

According to one embodiment and during a timeslot or period that does not include interference between the EAS system 102 and the metal detection system 104, the upper waveform 402 includes a first portion 408 in which the microprocessor gathers signal samples within the window 406. The signal samples are shown to include jitter. For example, sixteen samples may be captured from the first portion 408 within window 406. The upper waveform 402 includes a second portion 409 defined by a pulse waveform that represents the amount of time the microprocessor processes the signal samples.

The waveform schematic diagram 400 shows the lower waveform 404 to include a signal portion 410 within the window 406 that represents a derivative of the sixteen captured samples received at the front-end of the metal detection system 104. The signal portion 410 is defined by a flat line DC signal (e.g., without interference induced fluctuations). The lower waveform 404 includes a ring down portion 411 for the rectified transmission pulse. One of ordinary skill in the art will readily appreciate that any number of samples may be used.

Figure 5:
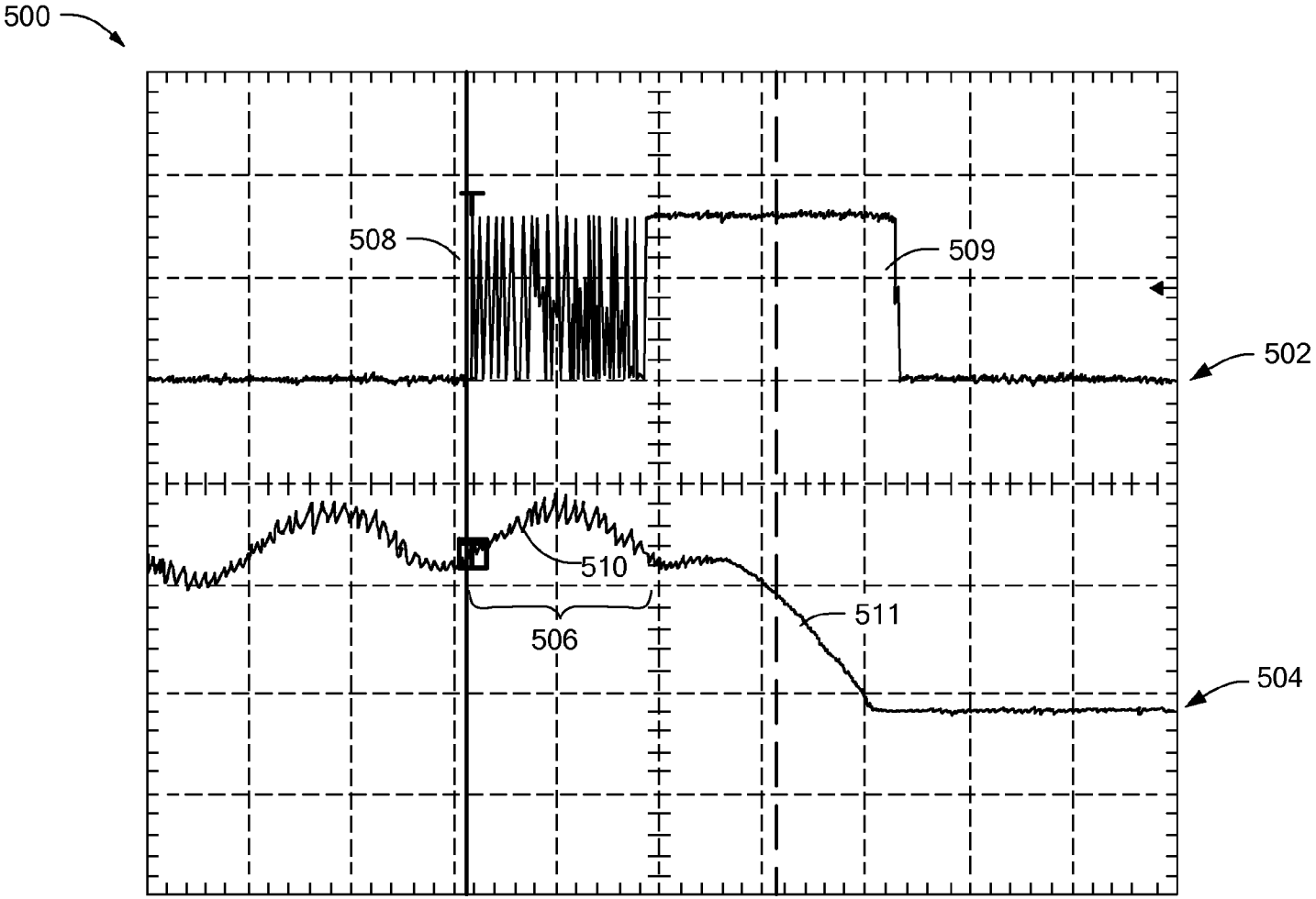
FIG. 5 is a waveform schematic diagram during a timeslot when interference is detected between the EAS system and the metal detection system.

FIG. 5 is a waveform schematic diagram 500 showing two exemplary traces of signals that are generated by the metal detection system 104 during a timeslot or period when interference is present between the EAS system 102 and the metal detection system 104. In particular, a 2 kHz interference signal is present between the EAS system 102 and the metal detection system 104. An upper waveform 502 illustrates a digital signal generated by a microprocessor within the metal detection system 104. A lower waveform 504 illustrates a signal received at a front-end of the metal detection system 104. A window 506 defines a time frame or region of interest that is used to analyze waveforms 502, 504.

According to one embodiment and during a timeslot or period that includes interference between the EAS system 102 and the metal detection system 104, the upper waveform 502 includes a first portion 508 in which the microprocessor gathers signal samples within the window 506. For example, sixteen samples may be captured from the first portion 508 within window 506. The upper waveform 502 includes a second portion 509 defined by a pulse waveform that represents the amount of time the microprocessor processes the signal samples.

The waveform schematic diagram 500 shows the lower waveform 504 to include a signal portion 510 within the window 506 that represents a derivative of the sixteen captured samples received at the front-end of the metal detection system 104. The signal portion 510 is defined by a DC signal having an interference signal that includes an overlying 2 kHz modulated sine wave. The lower waveform 504 includes a ring down portion 511 for the rectified transmission pulse. One of ordinary skill in the art will readily appreciate that any number of samples may be used or any signal frequency may induce interference. Once the interference is detected, the threshold value is adjusted using a faster average filter compared to when no interference is detected. The fast threshold adjustment enables the metal detection system 104 to track the noise signals, thereby minimizing false alarm trigger signals generated during drastic fluctuations in interference levels. For example, the metal detection system 104 may detect drastic fluctuations in interference levels when metal objects are positioned proximate to the antennas 107.

Figure 6:
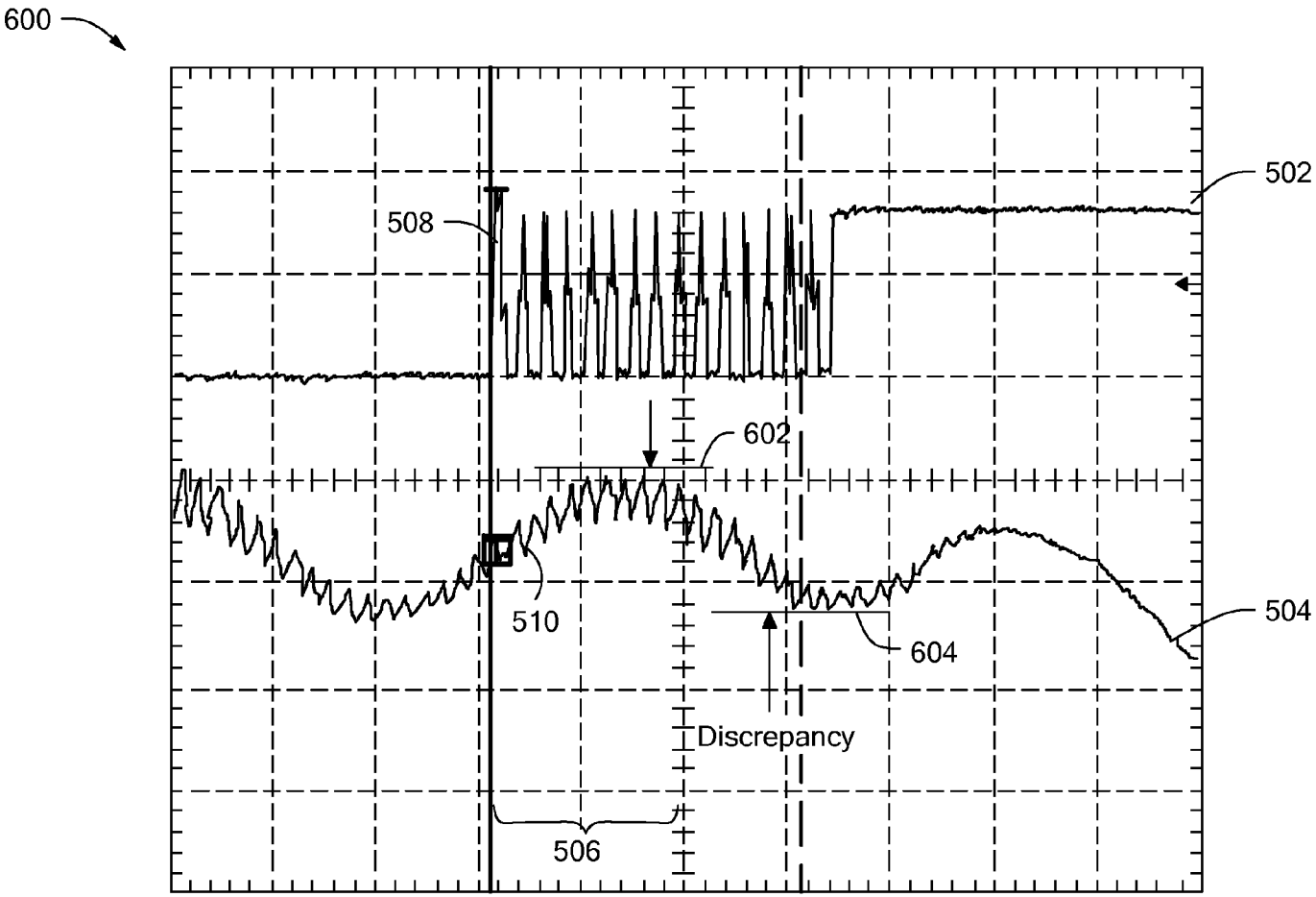
FIG. 6 is an expanded waveform schematic diagram of the diagram of FIG. 5.

FIG. 6 is a waveform schematic diagram 600 of an expanded view of the waveform schematic diagram 500 of FIG. 5. The upper waveform 502 illustrates the digital signal generated by a microprocessor within the metal detection system 104. The first portion 508 is illustrated within the window 506 to include jitter having an amplitude that is comparable to the amplitude of the digital pulse. The lower waveform 504 shows a signal portion 510 within the window 506 that represents a derivative of the sixteen captured samples received at the front-end of the metal detection system 104. The signal portion 510 shown within the window 506 includes a DC signal with an overlying 2 kHz modulated sine wave. A marker 602 is positioned within the window 506 to identify a maximum sample value. A marker 604 is positioned within the window 506 to identify a minimum sample value. According to one embodiment, the discrepancy calculating module 209 calculates a discrepancy value by determining a difference between the maximum value associated with marker 602 and the minimum value associated with marker 604.

The invention can be realized in hardware, software, or a combination of hardware and software. Any kind of computing system, or other apparatus adapted for carrying out the methods described herein, is suited to perform the functions described herein.

A typical combination of hardware and software could be a specialized computer system having one or more processing elements and a computer program stored on a storage medium that, when loaded and executed, controls the computer system such that it carries out the methods described herein. The invention can also be embedded in a computer program product, which comprises all the features enabling the implementation of the methods described herein, and which, when loaded in a computing system is able to carry out these methods. Storage medium refers to any volatile or non-volatile storage device.

Computer program or application in the present context means any expression, in any language, code or notation, of a set of instructions intended to cause a system having an information processing capability to perform a particular function either directly or after either or both of the following a) conversion to another language, code or notation; b) reproduction in a different material form.

In addition, unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A system for adjusting a threshold value of an alarm event trigger based on a detected interference level, the system comprising:

a discrepancy calculating module, the discrepancy calculating module using a plurality of sample values to calculate a discrepancy value based on a difference between a maximum value and a minimum value of the plurality of sample values;

a comparing module, the comparing module comparing the discrepancy value to a predefined interference threshold value and generating an activation signal;

a fast threshold adjustment module, the fast threshold module receiving the activation signal when the discrepancy value is at least equal to the predefined interference threshold value; and a slow threshold adjustment module, the slow threshold adjustment module receiving the activation signal when the discrepancy value is less than the predefined interference threshold value, the activation signal triggering an output from one of the fast threshold adjustment module and the slow threshold adjustment module, the output being used to adjust the threshold value.

2. The system according to claim 1, further comprising:

a normalizing module, the normalizing module receiving the plurality of sample values and calculating a normalized value for the plurality of sample values; and a processing module in communication with the normalizing module, the processing module using the normalized value to represent a single sample value.

3. The system according to claim 2, wherein the processing module provides the single sample value to the fast threshold adjustment module and the slow threshold adjustment module.

4. The system according to claim 3, wherein the fast threshold adjustment module includes a 200 tap low pass filter and the slow threshold adjustment module includes an 800 tap low pass filter.

5. The system according to claim 4, wherein the 200 tap low pass filter stores 200 previous sample values and averages the single sample value with the stored 200 previous sample values and the 800 tap low pass filter stores 800 previous sample values and averages the single sample value with the stored 800 previous sample values.

6. The system according to claim 5, further comprising a summing module that adds a hard threshold value and the output from one of the fast threshold adjustment module and the slow threshold adjustment module.

7. The system according to claim 1, further comprising a soft threshold module that calculates a soft threshold value based on a percentage of the discrepancy value.

8. The system according to claim 7, further comprising a summing module that adds the soft threshold value, a hard threshold value and the output from one of the fast threshold adjustment module and the slow threshold adjustment module.

9. A method for adjusting a threshold value of an alarm event trigger based on a detected interference level, the method comprising:

receiving a plurality of sample values;

calculating a discrepancy value based on a difference between a maximum value and a minimum value of the plurality of sample values;

comparing the discrepancy value to a predefined interference threshold value;

providing an activation signal to a fast threshold adjustor when the discrepancy value is at least equal to the predefined interference threshold value;

providing the activation signal to a slow threshold adjustor when the discrepancy value is less than the predefined interference threshold value;

generating an output from one of the fast threshold adjustor and the slow threshold adjustor that is triggered by the activation signal; and adjusting the threshold value based on the output from one of the fast threshold adjustor and the slow threshold adjustor.

10. The method according to claim 9, further comprising:

calculating an average for the plurality of sample values; and applying the average to generate a representative single sample value.

11. The method according to claim 10, further comprising providing the single sample value to the fast threshold adjustor and the slow threshold adjustor.

12. The method according to claim 11, further comprising providing a 200 tap low pass filter for the fast threshold adjustor and providing an 800 tap low pass filter for the slow threshold adjustor.

13. The method according to claim 12, further comprising:

storing 200 previous sample values in the 200 tap low pass filter;

averaging the single sample value and the stored 200 previous sample values;

providing an output for the 200 tap low pass filter;

storing 800 previous sample values in the 800 tap low pass filter;

averaging the single sample value and the stored 800 previous sample values; and providing an output for the 800 tap low pass filter.

14. The method according to claim 13, further comprising adding a hard threshold value and one of the output for the 200 tap low pass filter and the output for the 800 tap low pass filter.

15. The method according to claim 9, further comprising calculating a soft threshold value based on a percentage of the discrepancy value.

16. The method according to claim 15, further comprising adding the soft threshold value, a hard threshold value and one of the output for the 200 tap low pass filter and the output for the 800 tap low pass filter.

17. A security system for adjusting a threshold value of an alarm event trigger based on a detected interference level, the security system comprising:

an antenna;

an electronic surveillance system, the electronic surveillance system using the antenna to detect the presence of active markers;

a metal detection system, the metal detection system using the antenna to detect metal objects, the metal detection system comprising:

a discrepancy calculating module, the discrepancy calculating module using a plurality of sample values to calculate a discrepancy value based on a difference between a maximum value and a minimum value of the plurality of sample values;

a comparing module, the comparing module comparing the discrepancy value to a predefined interference threshold value and generating an activation signal;

a fast threshold adjustment module, the fast threshold adjustment module receiving the activation signal when the discrepancy value is at least equal to the predefined interference threshold value; and a slow threshold adjustment module, the slow threshold adjustment module receiving the activation signal when the discrepancy value is less than the predefined interference threshold value, the activation signal triggering an output from one of the fast threshold adjustment module and the slow threshold adjustment module, the output being used to adjust the threshold value.

18. The security system according to claim 17, the metal detection system comprising a soft threshold module that receives the discrepancy value and calculates a soft threshold value based on a percentage of the discrepancy value, the soft threshold module receiving the activation signal when the discrepancy value is greater than or equal to the predefined interference threshold value, the activation signal triggering an output from the soft threshold module, the output being used to adjust the threshold value.

19. The security system according to claim 18, the metal detection system further comprising a summing module that adds the soft threshold value, a hard threshold value and the output from one of the fast threshold adjustment module and the slow threshold adjustment module.

20. The security system according to claim 17, the metal detection system further comprising:

a normalizing module, the normalizing module receiving the plurality of sample values and calculating an average for the plurality of sample values;

a processing module, the processing module in communication with the normalizing module, the processing module using the calculated average to represent a single sample value that is derived from the plurality of sample values, the processing module providing the single sample value to the fast threshold adjustment module and the slow threshold adjustment module.

* * * * *